US010526775B2

(12) United States Patent
Nakamura et al.

(10) Patent No.: US 10,526,775 B2
(45) Date of Patent: Jan. 7, 2020

(54) TOILET AND TOILET APPARATUS

(71) Applicant: TOTO LTD., Kitakyushu-shi, Fukuoka (JP)

(72) Inventors: Kenichi Nakamura, Fukuoka (JP); Hiroshi Hashimoto, Fukuoka (JP); Shuichi Nagashima, Fukuoka (JP); Mayu Okubo, Fukuoka (JP); Shoko Imaizumi, Fukuoka (JP); Shinichi Urata, Fukuoka (JP); Isami Sakaba, Fukuoka (JP); Haruka Saito, Fukuoka (JP); Takumi Tsuchitani, Fukuoka (JP)

(73) Assignee: TOTO LTD., Kitakyushu-shi (JP)

( * ) Notice: Subject to any disclaimer, the term of this patent is extended or adjusted under 35 U.S.C. 154(b) by 0 days.

(21) Appl. No.: 15/865,373

(22) Filed: Jan. 9, 2018

(65) Prior Publication Data

US 2018/0202140 A1 Jul. 19, 2018

(30) Foreign Application Priority Data

Jan. 16, 2017 (JP) ..... 2017-005371

(51) Int. Cl.
*E03D 11/14* (2006.01)
*E03D 1/012* (2006.01)

(52) U.S. Cl.
CPC ..... *E03D 11/143* (2013.01); *E03D 1/012* (2013.01)

(58) Field of Classification Search
CPC ..... E03D 11/143; E03D 1/012
USPC ..... 4/300, 420, 421, 252.2
See application file for complete search history.

(56) References Cited

U.S. PATENT DOCUMENTS 2,097,174 A * 10/1937 Brain et al. ..... E03D 11/14 4/421
2,341,043 A * 2/1944 Hoffmann ..... E03D 11/02 4/421
5,184,355 A * 2/1993 Taguchi ..... E03D 9/00 4/420
6,415,457 B2 * 7/2002 Schmucki ..... E03D 11/06 4/420
8,881,318 B2 * 11/2014 Stammel ..... E03D 11/14 4/252.2

* cited by examiner

*Primary Examiner* — Tuan N Nguyen
(74) *Attorney, Agent, or Firm* — Amin, Turocy & Watson, LLP

(57) ABSTRACT

A toilet according to an embodiment includes a toilet body and a water drainage socket. The toilet body has a water drainage outlet on a back surface thereof. The water drainage socket connects the water drainage outlet and an inlet of a water drainage pipe that is provided on a wall surface. The back surface of the toilet body is provided with an opening and a guide part. The opening is provided to insert therethrough a tubular member that extends from the wall surface in a case where the toilet body is mounted on the wall surface. The guide part guides the tubular member that is provided in a state where it is inserted through the opening so as to move to an outer side of the water drainage socket in a case where the toilet body is mounted on the wall surface.

5 Claims, 7 Drawing Sheets

TOILET AND TOILET APPARATUS

CROSS-REFERENCE TO RELATED APPLICATION

The present application claims priority to and incorporates by reference the entire contents of Japanese Patent Application No. 2017-005371 filed in Japan on Jan. 16, 2017.

FIELD

An embodiment of the disclosure relates to a toilet and a toilet apparatus.

BACKGROUND

Conventionally, a wall-hung type toilet is provided to connect a water drainage outlet on a back surface of a toilet body to an inlet of a water drainage pipe that is provided on a wall surface, through a water drainage socket, in a case where the toilet body is mounted on the wall surface. In such a case, for example, a water drainage socket is preliminarily attached to an inlet of a water drainage pipe or a water drainage outlet on a back surface of a toilet body.

In such a toilet, a tubular member such as a water supply hose or an electrical power source cable that extends from a wall surface may be inserted through an opening that is formed on a back surface of a toilet body and drawn into an interior of the toilet body, immediately before a water drainage outlet of the toilet body is connected to an inlet of a water drainage pipe on the wall surface though a water drainage socket (see, for example, Japanese Laid-open Patent Publication No. 2016-163651).

However, in a conventional toilet as described above, a tubular member that is inserted through an opening may be interposed between a water drainage socket and a water drainage outlet or between the water drainage socket and a wall surface with a water drainage pipe being provided thereon, at a time of connection between the water drainage outlet on a back surface of a toilet body and an inlet of the water drainage pipe, during an operation for mounting the toilet body on the wall surface, so that it may be impossible to execute the operation for mounting the toilet body smoothly. That is, there is room for improvement in workability of a conventional toilet as described above.

SUMMARY

It is an object of the present invention to at least partially solve the problems in the conventional technology.

A toilet according to an embodiment includes a toilet body and a water drainage socket. The toilet body has a water drainage outlet on a back surface thereof. The water drainage socket connects the water drainage outlet and an inlet of a water drainage pipe that is provided on a wall surface. The back surface of the toilet body is provided with an opening and a guide part. The opening is provided to insert therethrough a tubular member that extends from the wall surface in a case where the toilet body is mounted on the wall surface. The guide part guides the tubular member that is provided in a state where it is inserted through the opening so as to move to an outer side of the water drainage socket in a case where the toilet body is mounted on the wall surface.

BRIEF DESCRIPTION OF DRAWINGS

The above and other objects, features, advantages and technical and industrial significance of this invention will be better understood by reading the following detailed description of presently preferred embodiments of the invention, when considered in connection with the accompanying drawings, wherein.

DESCRIPTION OF EMBODIMENT

Hereinafter, an embodiment of a toilet and a toilet apparatus as disclosed in the present application will be described in detail with reference to the accompanying drawings. Additionally, this invention is not limited by an embodiment as illustrated below. Furthermore, the drawings are schematic, so that it has to be noted that a dimensional relationship between respective elements, a ratio between respective elements, or the like may be different from a real one. Among drawings, a part with a mutually different dimensional relationship or ratio may also be included therein.

General Configuration of Toilet 1

Figure 1:
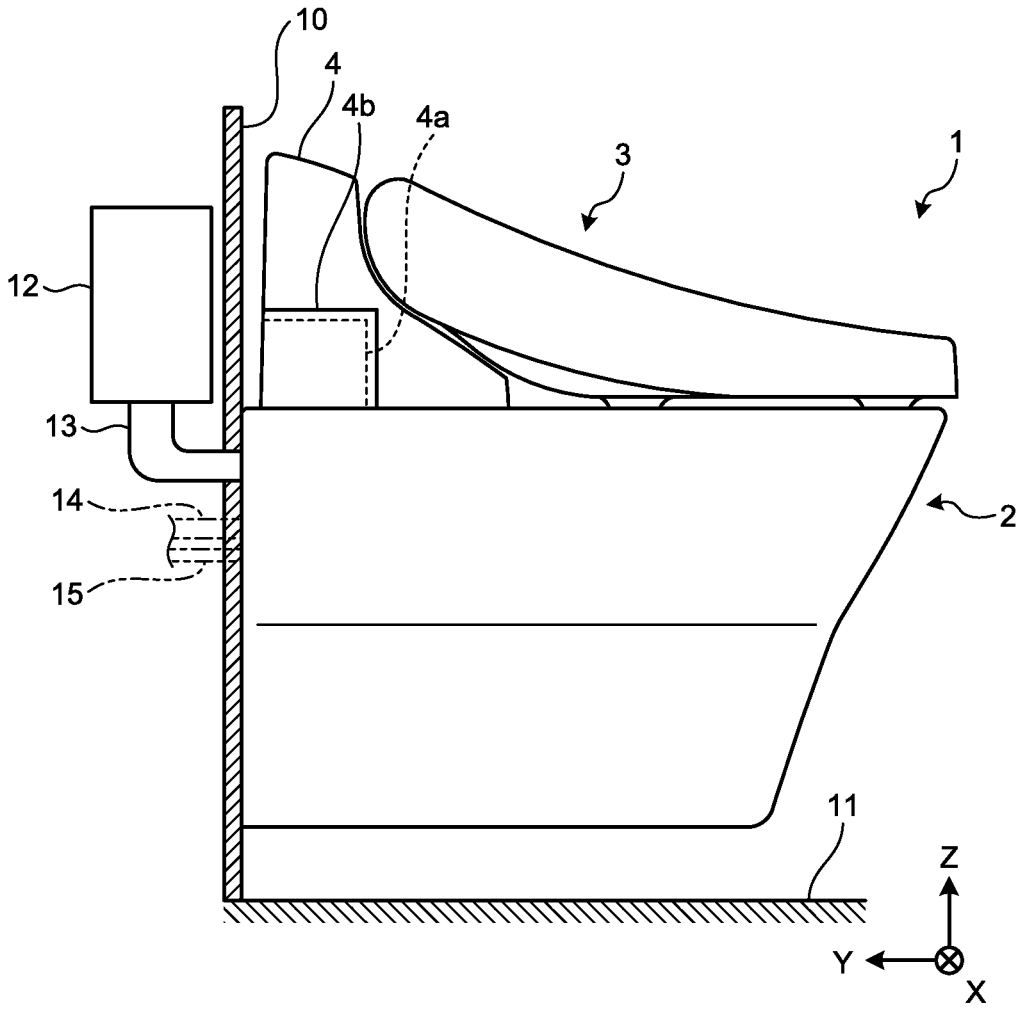
FIG. 1 is a left side view of a toilet according to an embodiment.

First, a general configuration of a toilet 1 according to an embodiment will be described with reference to FIG. 1. FIG. 1 is a left side view of the toilet 1 according to an embodiment. Additionally, FIG. 1 illustrates a state where the toilet 1 is mounted on a wall surface 10. Furthermore, FIG. 1 illustrates the wall surface 10 and a floor surface 11 in a cross section.

Furthermore, FIG. 1 illustrates a three-dimensional orthogonal coordinate system that includes a Z-axis with a positive direction being a vertically upward direction for readily understanding an explanation. Such an orthogonal coordinate system may also be illustrated in another figure. In such an orthogonal coordinate system, a positive direction of a Y-axis, a positive direction of an X-axis, a negative direction of the X-axis, and a negative direction of a Z-axis are defined as a front surface, a left side surface, a right side surface, a planar surface (that is also referred to as an "upper surface"), respectively. Hence, in the following description (s), a direction of an X-axis, a direction of a Y-axis, and a direction of a Z-axis may be referred to as a leftward or rightward direction, a forward or backward direction, and an upward or downward direction, respectively.

Furthermore, the toilet 1 according to an embodiment is a so-called wall-hung type toilet that is mounted on the wall surface 10. Additionally, in the present embodiment, a flush-type toilet (flush toilet) is illustrated as the toilet 1. As illustrated in FIG. 1, the toilet 1 includes a toilet body 2 and a private part washing device 3. The toilet body 2 is made of, for example, a ceramic. Additionally, a detail of the toilet body 2 will be described later by using FIG. 2 and FIG. 3.

The private part washing device 3 includes a functional part 4 that has a washing nozzle, a motor for driving a nozzle, a motor control device (none of them are illustrated), and the like. The private part washing device 3 is provided on an upper part of the toilet body 2, for washing a private part of a user, and washes such a private part of a user with washing water that is spouted from a washing nozzle. The functional part 4 includes an exposure part 4*a* on, for example, a left side of a back part of a casing. Furthermore, the functional part 4 includes a shielding plate 4*b* that covers the exposure part 4*a*.

The toilet 1 is mounted on the wall surface 10 as described above. In a state where the toilet 1 is mounted on the wall surface 10, the toilet 1 separates from the floor surface 11. A water storage tank 12 that stores washing water therein is provided on an inner side of the wall surface 10. Additionally, an "inner side of the wall surface 10" means a surface side of the wall surface 10 that is opposite to a room (toilet room) where the toilet 1 is placed therein. In the toilet 1, washing water is supplied to the toilet body 2 of the toilet 1 through a water supply pipe 13 that is connected to the water storage tank 12.

Herein, so-called water supply electrical power supply hiding is applied to the toilet 1 (flush toilet), in a such a manner that a tubular member 23 or 24 (see FIG. 4A and FIG. 4B) that is connected to the private part washing device 3 or extends from the private part washing device 3 is housed in an interior of the toilet body 2 to be hidden from or not to be exhibited to an exterior. A water supply hose connection part 14 that is connected to a water supply hose 23 that is a tubular member and an electrical power source cable connection part 15 that is connected to an electrical power source cable 24 that is a tubular member are provided on an inner side of the wall surface 10.

Additionally, for example, a long member that has flexibility, such as a pipe (flexible pipe), a hose, or an electrical wire such as a cable or a cord, is collectively referred to as a "tubular member".

The exposure part 4*a* that is provided on a left side of a back part of a casing of the private part washing device 3 is connected to base end parts of the water supply hose 23 and the electrical power source cable 24. As described above, the exposure part 4*a* is covered by the shielding plate 4*b* in order to hide connection parts of the water supply hose 23 and the electrical power source cable 24 to the private part washing device 3. Additionally, a fitting for connection 23*a* (see FIG. 4A) is provided on a tip part of the water supply hose 23. A plug 24*a* (see FIG. 4A) is provided on a tip part of the electrical power source cable 24.

Toilet Body 2

Figure 2:
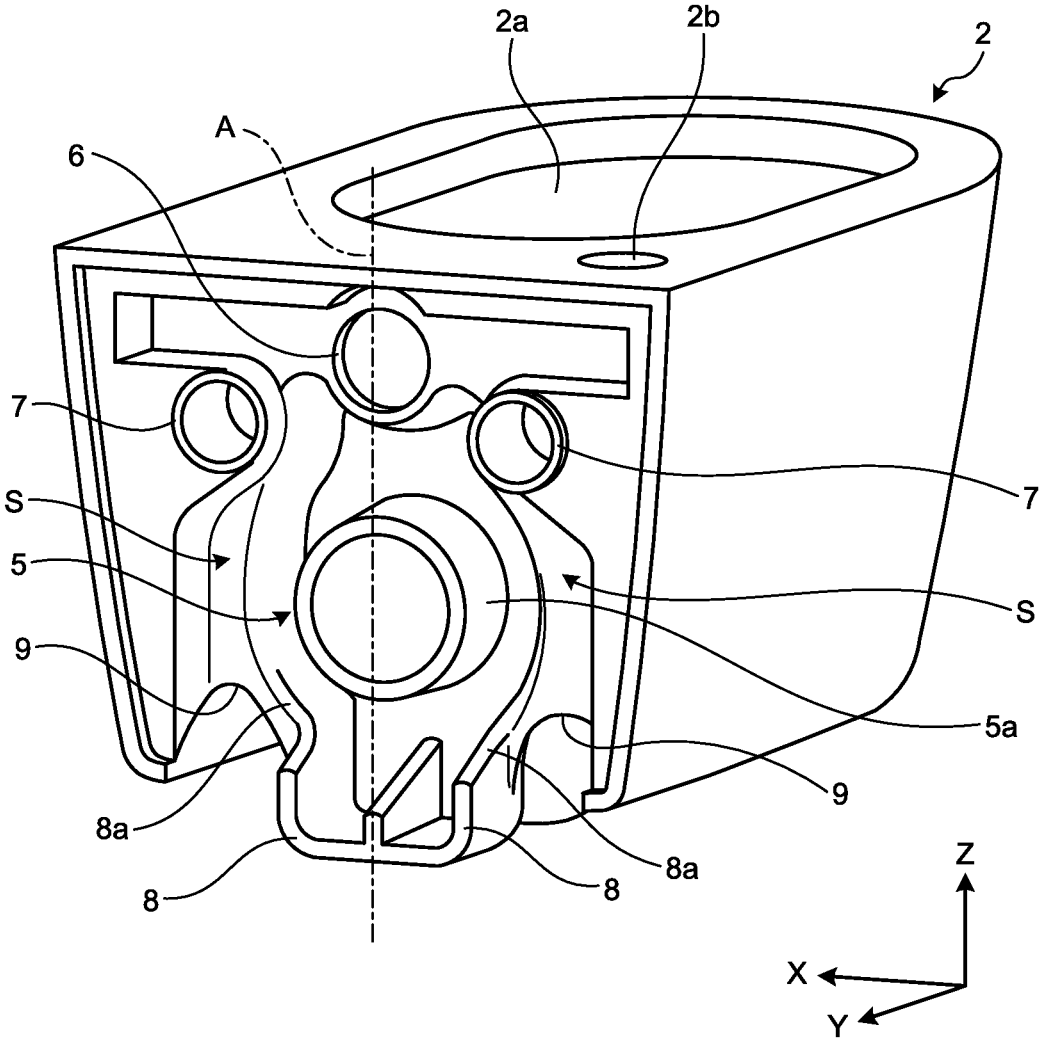
FIG. 2 is a perspective view of a toilet body.
Figure 3:
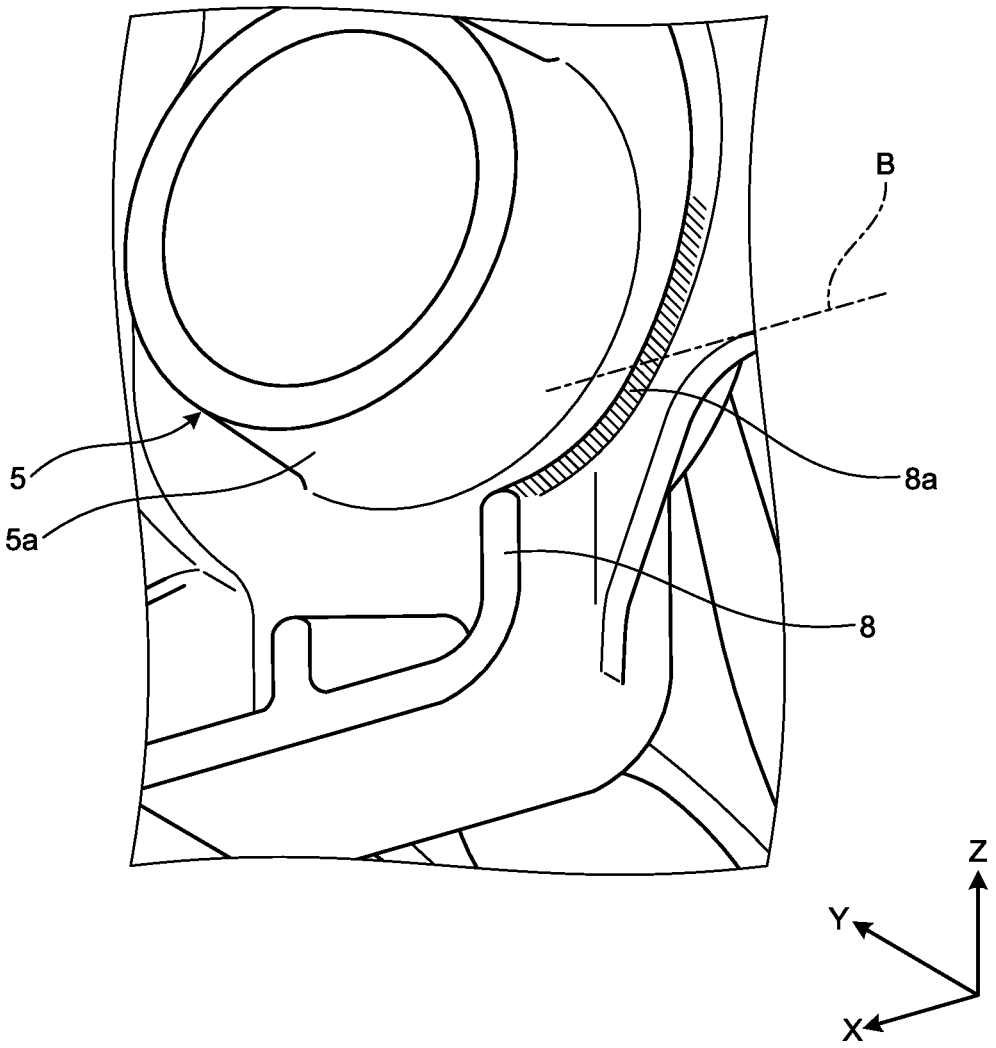
FIG. 3 is an enlarged perspective view of a main part of a toilet body.

Next, the toilet body 2 will be described with reference to FIG. 2. FIG. 2 is a perspective view of the toilet body 2. FIG. 3 is an enlarged perspective view of a main part of the toilet body 2. Additionally, each of FIG. 2 and FIG. 3 illustrates a case where the toilet body 2 is viewed from a back part thereof in order to illustrate a back surface of the toilet body 2.

As illustrated in FIG. 2, the toilet body 2 includes a bowl part 2*a* and an insertion hole 2*b* on an upper surface thereof. The bowl part 2*a* includes a bowl-shaped receiving surface that receives waste. The bowl part 2*a* leads to a water drainage outlet 5 as described later through a (non-illustrated) water drainage pipeline. The insertion hole 2*b* is provided to insert therethrough the water supply hose 23 and the electrical power source cable 24 that are drawn into an interior of the toilet body 2. The water supply hose 23 and the electrical power source cable 24 are drawn from an interior of the toilet body 2 to an upper surface of the toilet body 2 through the insertion hole 2*b* and connected to the functional part 4 (see FIG. 1).

Furthermore, the toilet body 2 includes the water drainage outlet 5, a water supply inlet 6, insertion holes 7 and 7, guide parts 8 and 8, and openings 9 and 9 on a back surface thereof. The water drainage outlet 5 is provided at a substantially center of a back surface of the toilet body 2. The water drainage outlet 5 has, for example, a cylindrical outer wall 5*a* that is provided around an opening. The water drainage outlet 5 is connected to a connection port 20*a* (see FIG. 4A) of a water drainage socket 20 while the outer wall 5*a* is a connection part thereof. The water drainage outlet 5 is connected to an inlet 16 (see FIG. 4B) of a water drainage pipe as described later on the wall surface 10 (see FIG. 4A) through the water drainage socket 20 (see FIG. 4A).

The water supply inlet 6 is formed above the water drainage outlet 5 on a back surface of the toilet body 2. The water supply inlet 6 is connected to a connection part 21 (see FIG. 4A) of a water supply pipe as described later on the wall surface 10. The insertion holes 7 and 7 are formed between the water drainage outlet 5 and the water supply inlet 6 in upward and downward directions (directions of a Z-axis) on a back surface of the toilet body 2 and symmetrically in leftward and rightward directions (directions of an X-axis) with respect to a center line A on the back surface. The insertion holes 7 and 7 are provided to insert therethrough supporting members 22 and 22 as described below on the wall surface 10, respectively.

The guide parts 8 and 8 are provided to protrude symmetrically in leftward and rightward directions with respect to a center line A of a back surface of the toilet body 2 below the water drainage outlet 5 on the back surface. The guide parts 8 and 8 are provided on an outer side of the outer wall 5*a* of the water drainage outlet 5. An "outer side" in such a case is a side that is provided in a direction away from a center of the water drainage outlet 5 on a back surface of the toilet body 2 in a back view. On the other hand, an "inner side" is a side that is provided in a direction close to a center of the water drainage outlet 5 on a back surface of the toilet body 2 in a back view. The guide parts 8 and 8 protrude backward (in a positive direction of a Y-axis) from a back surface of the toilet body 2 and are formed into a rib shape that extends in upward and downward directions.

The guide parts 8 and 8 slides, on a tip surface thereof, the water supply hose 23 and the electrical power source cable 24 (see FIG. 4A, FIG. 4B, or the like) that are tubular members that extend from the wall surface 10 as the toilet body 2 is caused to be close to the wall surface 10 by a human hand or the like in a case where the toilet body 2 is mounted on the wall surface 10.

The guide parts 8 and 8 guide the water supply hose 23 and the electrical power source cable 24 in such a manner that the water supply hose 23 and the electrical power source cable 24 move to an outer side of the water drainage socket 20 (see FIG. 4A, FIG. 4B, or the like) that is connected to the water drainage outlet 5. Additionally, movement of the water supply hose 23 and the electrical power source cable 24 that is caused by the guide parts 8 and 8 will be described later by using FIG. 6A and FIG. 6B.

Furthermore, the guide parts 8 and 8 are coupled with a rib that extends in leftward and rightward directions on a lower end thereof to be formed into a U-shape. Furthermore, in a case where the toilet body 2 is mounted on the wall surface 10, the guide parts 8 and 8 cause a tip surface thereof to contact the wall surface 10 to be a supporting part that supports the toilet body 2 that is mounted on the wall surface 10.

As illustrated in FIG. 3, the guide parts 8 and 8 have sloping surfaces 8*a* and 8*a*, respectively, halfway from bottom to top in upward and downward directions.

The openings 9 and 9 are formed symmetrically in leftward and rightward directions with respect to a center line A of a back surface of the toilet body 2 on the back surface. The openings 9 and 9 are formed into a notch shape with an opened lower end on both ends of a back surface of the toilet body 2 in leftward and rightward directions. The openings 9 and 9 are provided to insert therethrough the water supply hose 23 and the electrical power source cable 24 that are tubular members. In a case where the toilet body 2 is mounted on the wall surface 10, the water supply hose 23 and the electrical power source cable 24 are inserted through the openings 9 and 9 by a human hand or the like before the toilet body 2 is mounted on the wall surface 10.

Furthermore, it is preferable to form the openings 9 and 9 on an outer side of side ends of the water drainage outlet 5 in leftward and rightward directions on a back surface of the toilet body 2 (a side that is provided in a direction away from a center of the water drainage outlet 5 on a back surface of the toilet body 2 in a back view). Furthermore, it is preferable to form the openings 9 and 9 on an outer side of side ends of the water drainage socket 20 (see FIG. 4A) as described later that is connected to the water drainage outlet 5 in leftward and rightward directions on a back surface of the toilet body 2. In such a case, it is preferable to provide the guide parts 8 and 8 on an inner side of the openings 9 and 9 in leftward and rightward directions that are provided on an outer side of side ends of the water drainage outlet 5 in leftward and rightward directions (a side that is provided in a direction close to a center of the water drainage outlet 5 on a back surface of the toilet body 2 in a back view).

Additionally, the openings 9 and 9 are formed in such a manner that the whole of such an opening does not have to be positioned on an outer side of side ends of the water drainage outlet 5 in leftward and rightward directions and one of left and right side ends thereof is positioned on (or displaced to) an outer side of side ends of the water drainage outlet 5 in leftward and rightward directions in a back view.

Furthermore, as illustrated in FIG. 3, it is preferable to form the openings 9 and 9 below side ends of the water drainage outlet 5 in leftward and rightward directions on a back surface of the toilet body 2. Furthermore, it is preferable to form the openings 9 and 9 below side ends of the water drainage socket 20 as described later that is connected to the water drainage outlet 5 in leftward and rightward directions on a back surface of the toilet body 2. In such a case, it is preferable for the guide parts 8 and 8 to extend above upper ends (or an upper end line B) of the openings 9 and 9 that are provided below side ends of the water drainage outlet 5 in leftward and rightward directions.

Additionally, as illustrated in FIG. 2, the openings 9 and 9 are formed in concave spaces S and S that are formed on a back surface of the toilet body 2. The concave spaces S and S are each formed on an outer side of left and right side ends of the water drainage outlet 5 on a back surface of the toilet body 2 and are spaces for housing tubular members (the water supply hose 23 and the electrical power source cable 24) that are guided from the wall surface 10 to the openings 9 and 9 in a case where the toilet body 2 is mounted on the wall surface 10 (see FIG. 4A) as described later.

Wall Surface 10

Figure 4A:
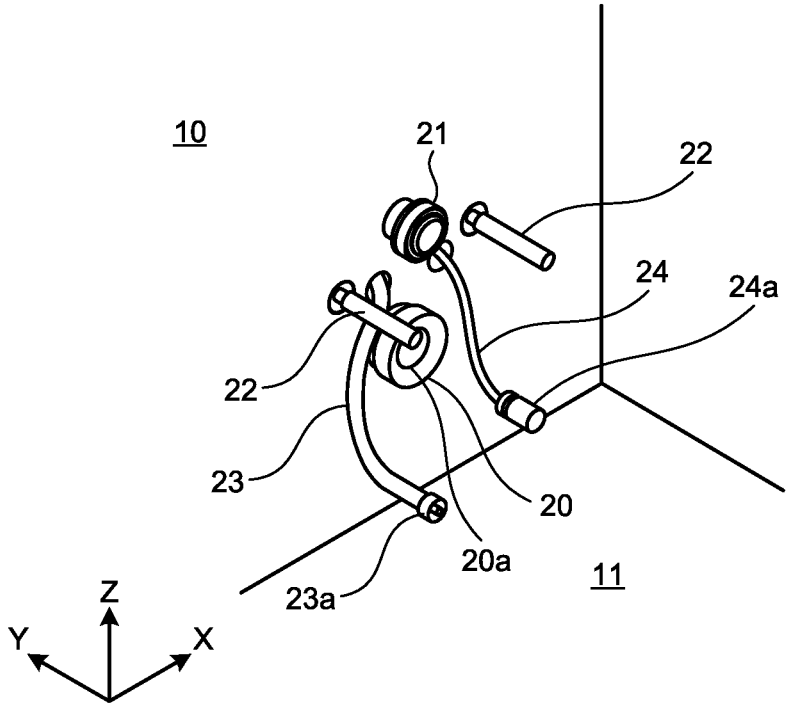
FIG. 4A is a perspective view of a wall surface with a toilet body being mounted thereon.
Figure 4B:
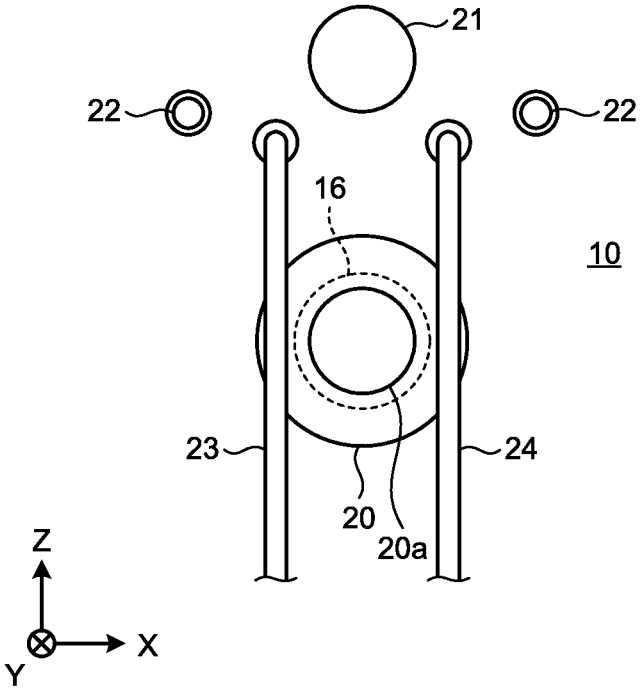
FIG. 4B is a front elevational view of a wall surface with a toilet body being mounted thereon.

Next, the wall surface 10 with the toilet body 2 being mounted thereon will be described with reference to FIG. 4A and FIG. 4B. FIG. 4A is a perspective view of the wall surface 10 with the toilet body 2 being mounted thereon. FIG. 4B is a front elevational view of a wall surface with the toilet body 2 being mounted thereon.

As illustrated in FIG. 4A and FIG. 4B, the wall surface 10 is a perpendicular surface that is orthogonal to the floor surface 11. The wall surface 10 is provided with the inlet 16 of a water drainage pipe, the connection part 21 of a (non-illustrated) water supply pipe, the supporting members 22 and 22, the water supply hose 23 that is a tubular member, the electrical power source cable 24 that is a tubular member, and the like.

The inlet 16 of a water drainage pipe is provided on the wall surface 10 and protrudes from the wall surface 10 toward a side of a toilet room. Furthermore, the water drainage socket 20 is attached to the inlet 16 of a water drainage pipe. The water drainage socket 20 connects the inlet 16 of a water drainage pipe and the water drainage outlet 5 on a back side of the toilet body 2. Additionally, although an example of the water drainage socket 20 that is preliminarily attached to the inlet 16 of a water drainage pipe is described in the present embodiment, the water drainage socket 20 may preliminarily be attached to, for example, the water drainage outlet 5 on a back side of the toilet body 2.

The connection part 21 of a water supply pipe is provided to protrude above the inlet 16 of a water drainage pipe and the water drainage socket 20 on the wall surface 10. The connection part 21 of a water supply pipe is connected to the water supply inlet 6 on a back surface of the toilet body 2 to supply washing water to the toilet body 2.

The supporting members 22 and 22 are formed into a rod shape, are provided symmetrically in leftward and rightward directions (directions of an X-axis) between the inlet 16 of a water drainage pipe and the connection part 21 of a water supply pipe in upward and downward directions (directions of a Z-axis) on wall surface 10, and protrude forward (in a negative direction of a Y-axis) from the wall surface 10.

The water supply hose 23 and the electrical power source cable 24 that are tubular members are provided side by side in leftward and rightward directions on an inner side of the supporting members 22 and 22 (a side that is provided in a direction close to an in-plane center on a back surface of the toilet body 2 in a back view). Both the water supply hose 23 and the electrical power source cable 24 extend from the wall surface 10 and overlap with the inlet 16 of a water drainage pipe or the water drainage socket 20 in a plan view (when viewed in a positive direction of a Y-axis) as illustrated in FIG. 4B in a state where they hang down due to their own weights.

Thus, the water supply hose 23 and the electrical power source cable 24 that are tubular members overlap with the inlet 16 of a water drainage pipe or the water drainage socket 20 in a plan view, so that the water supply hose 23 and the electrical power source cable 24 may be interposed between the water drainage outlet 5 on a back side of the toilet body 2 and the water drainage socket 20 that is attached to the inlet 16 of a water drainage pipe in a case where the toilet body 2 is mounted on the wall surface 10 (or between the water drainage socket 20 and the wall surface 10 with a water drainage pipe being provided thereon in a case where the water drainage socket 20 is attached to the water drainage outlet 5 on a back side of the toilet body 2). Furthermore, the toilet body 2 is comparatively weighty, so that the toilet body 2 has to be horizontally mounted on the wall surface 10 while keeping a space with respect to the floor surface 11. Accordingly, an operation for mounting the toilet body 2 is cumbersome.

The toilet 1 according to an embodiment is configured in such a manner that the water supply hose 23 and the electrical power source cable 24 automatically avoid the water drainage socket 20 that is connected to the water drainage outlet 5 due to the guide parts 8 and 8. Additionally, in such a case, it is sufficient for a worker to bring the toilet body 2 close to the wall surface 10.

Steps of Mounting of Toilet Body 2

Figure 5:
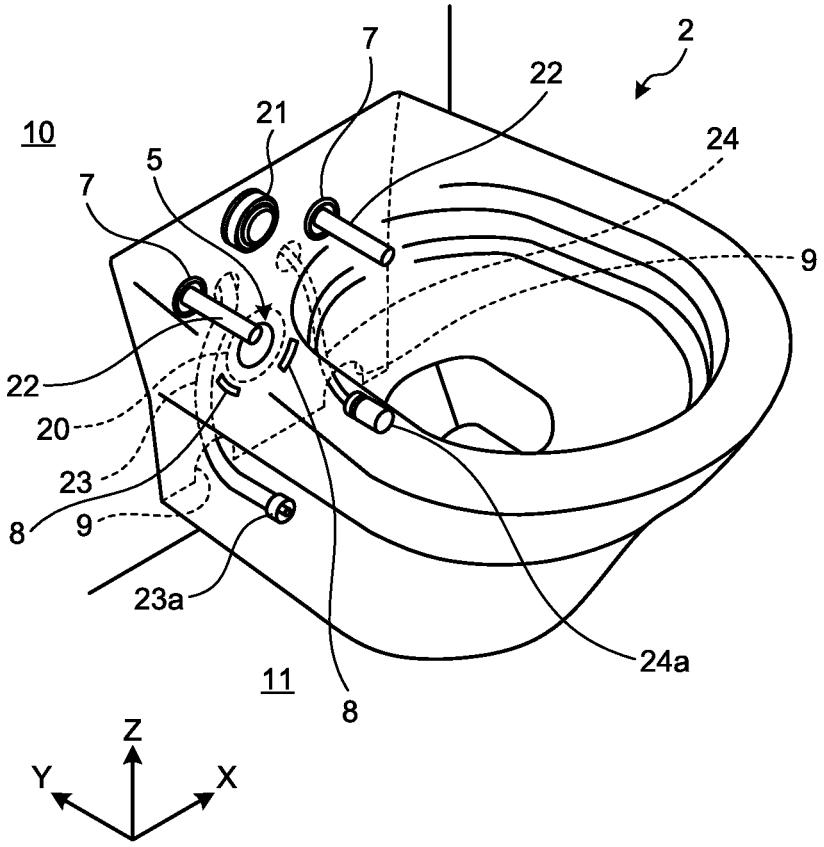
FIG. 5 is a perspective view of a mounting state of a toilet body.
Figure 6A:
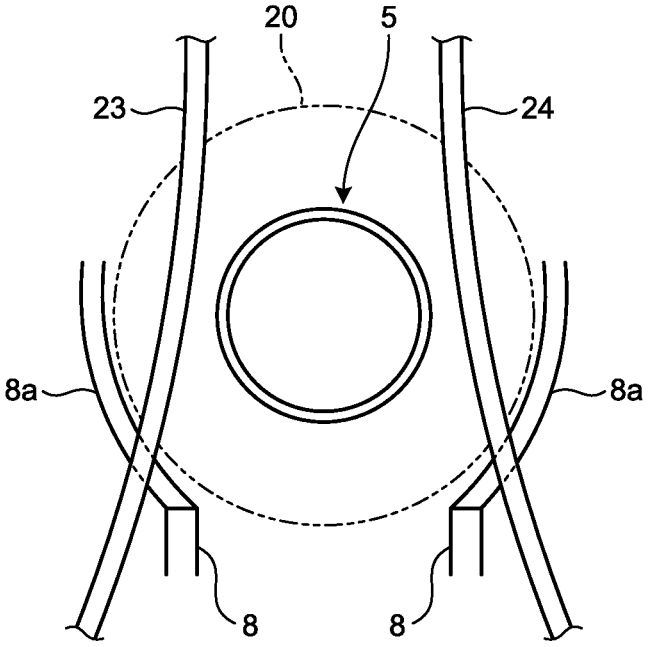
FIG. 6A is a diagram (part 1) illustrating an operation of a tubular member at a time of mounting of a toilet body.
Figure 6B:
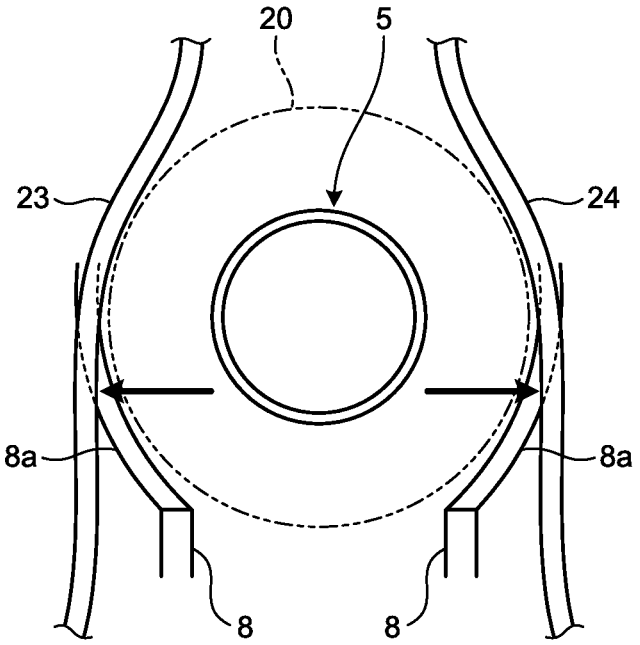
FIG. 6B is a diagram (part 2) illustrating an operation of a tubular member at a time of mounting of a toilet body.

Next, steps of mounting the toilet body 2 on the wall surface 10 will be described with reference to FIG. 5 to FIG. 6B. FIG. 5 is a perspective view of a mounting state of the toilet body 2. FIG. 6A and FIG. 6B are diagrams illustrating operations of the tubular members 23 and 24 at a time of mounting of the toilet body 2. Additionally, FIG. 6A and FIG. 6B illustrate a case where the toilet body 2 is viewed from the wall surface 10.

As illustrated in FIG. 5, the water supply hose 23 and the electrical power source cable 24 that are tubular members are drawn into an interior of the toilet body 2 through the openings 9 and 9 in a state where the toilet body 2 is mounted on the wall surface 10. Additionally, the water supply hose 23 and the electrical power source cable 24 are inserted through the insertion hole 2*b* (see FIG. 2) on an upper surface of the toilet body 2, drawn toward a side of such an upper surface of the toilet body 2, and connected to the functional part 4 (see FIG. 1) by the fitting for connection 23*a* of the water supply hose 23 and the plug 24*a* of the electrical power source cable 24.

Furthermore, the supporting members 22 and 22 that protrude from the wall surface 10 are inserted through the insertion holes 7 and 7 of the toilet body 2, so that the toilet body 2 is supported by the wall surface 10. Additionally, as described above, the guide parts 8 and 8 of the toilet body 2 also function as supporting parts that support the toilet body 2 on the wall surface 10.

Herein, in a case where the toilet body 2 is mounted on the wall surface 10, the water supply hose 23 and the electrical power source cable 24 are first inserted through the openings 9 and 9 of the toilet body 2, respectively, by a human hand. Then, the toilet body 2 is carried by a human hand or the like and caused to be close to the wall surface 10 gradually so as to be horizontal with respect to the wall surface 10. Then, each part on a side of the wall surface 10 such as the inlet 16 of a water drainage pipe (see FIG. 4B) on the wall surface 10 is connected to each corresponding part on a side of the toilet body 2 such as the water drainage outlet 5 of the toilet body 2. Thereby, mounting of the toilet body 2 on the wall surface 10 is completed.

Furthermore, in a process of causing the toilet body 2 to be close to the wall surface 10, the guide parts 8 and 8 guide the water supply hose 23 and the electrical power source cable 24 that are tubular members so as to move to an outer side of the water drainage socket 20. Herein, the water supply hose 23 and the electrical power source cable 24 slide upward on sloping surfaces 8*a* and 8*a* of the guide parts 8 and 8 as illustrated in FIG. 6A and are displaced outward so as to be separate from a center of the water drainage socket 20 in leftward and rightward directions so that a space between the water drainage outlet 5 and the water drainage socket 20 (a space in forward and backward directions) is avoided in a case where the water drainage socket 20 is preliminarily attached to the inlet 16 of a water drainage pipe as illustrated in FIG. 6B.

In the toilet 1 according to an embodiment as described above, the water supply hose 23 and the electrical power source cable 24 that are tubular members that are provided in a state where they are inserted through the openings 9 and 9 are guided by the guide parts 8 and 8 so as to move to an outer side of the water drainage socket 20 (a side that is provided in a direction away from a center of the water drainage socket 20 on the wall surface 10 in a front elevational view) in a case where the toilet body 2 is mounted on the wall surface 10. Thereby, it is possible to prevent the water supply hose 23 and the electrical power source cable 24 from being interposed between the water drainage socket 20 and the water drainage outlet 5 (or between the water drainage socket 20 and the wall surface 10 with a water drainage pipe being provided thereon in a case where the water drainage socket 20 is attached to the water drainage outlet 5 on a back surface of the toilet body 2) during an operation for mounting the toilet body 2, so that it is possible to improve workability.

Furthermore, according to the toilet 1 as described above, the openings 9 and 9 are formed on an outer side of side ends of the water drainage outlet 5 in leftward and rightward directions on a back surface of the toilet body 2 (a side that is provided in a direction away from a center of the water drainage outlet 5 on a back surface of the toilet body 2 in a back view) and the guide parts 8 and 8 are provided on an inner side of the openings 9 and 9 in leftward and rightward directions (a side that is provided in a direction close to a center of the water drainage outlet 5 on a back surface of the toilet body 2 in a back view). Thereby, in a case where the toilet body 2 is mounted on the wall surface 10, the water supply hose 23 and the electrical power source cable 24 are displaced outward from a center of the water drainage outlet 5 (a center line A in FIG. 2) in leftward and rightward directions by the openings 9 and 9 and the water supply hose 23 and the electrical power source cable 24 that are displaced outward from a center of the water drainage outlet 5 (a center line A) in leftward and rightward directions are guided to an outer side of the water drainage socket 20 by the guide parts 8 and 8, so that it is possible to further prevent the water supply hose 23 and the electrical power source cable 24 from being interposed between the water drainage socket 20 and the water drainage outlet 5 (or between the water drainage socket 20 and the wall surface 10 with a water drainage pipe being provided thereon in a case where the water drainage socket 20 is attached to the water drainage outlet 5 on a back surface of the toilet body 2) during an operation for mounting the toilet body 2.

Furthermore, the water supply hose 23 and the electrical power source cable 24 move to an outer side of the water drainage socket 20 during an operation for mounting the toilet body 2 to be provided on a further outer side in leftward and rightward directions on a back surface of the toilet body 2, so that an approach for drawing the water supply hose 23 and the electrical power source cable 24 into, for example, an interior of the toilet body 2 is facilitated.

Furthermore, according to the toilet 1 as described above, the openings 9 and 9 are formed below side ends of the water drainage outlet 5 in leftward and rightward directions on a back surface of the toilet body 2 and the guide parts 8 and 8 are provided to extend above upper ends of the openings 9 and 9. Thereby, in a case where the toilet body 2 is mounted on the wall surface 10, the water supply hose 23 and the electrical power source cable 24 are reliably displaced outward from a center of the water drainage outlet 5 (a center line A in FIG. 2) in leftward and rightward directions by the openings 9 and 9 and the water supply hose 23 and the electrical power source cable 24 that are displaced outward from a center of the water drainage outlet 5 (a center line A) in leftward and rightward directions are guided to an outer side of the water drainage socket 20 by the guide parts 8 and 8. Hence, it is possible to further prevent the water supply hose 23 and the electrical power source cable 24 from being interposed between the water drainage socket 20 and the water drainage outlet 5 (or between the water drainage socket 20 and the wall surface 10 with a water drainage pipe being provided thereon in a case where the water drainage socket 20 is attached to the water drainage outlet 5 on a back surface of the toilet body 2) during an operation for mounting the toilet body 2.

Furthermore, according to the toilet 1 as described above, the guide parts 8 and 8 have sloping surfaces 8*a* and 8*a* that slope from back to front in frontward and backward directions halfway from bottom to top, so that a gap is formed between back end surfaces of the guide parts 8 and 8 and the wall surface 10 in a state where the toilet body 2 is mounted on the wall surface 10. Thereby, it is possible to prevent the water supply hose 23 and the electrical power source cable 24 from being interposed between the guide parts 8 and 8 and the wall surface 10 in a state where the toilet body 2 is mounted on the wall surface 10.

Furthermore, in a case where the toilet body 2 is mounted on the wall surface 10, the water supply hose 23 and the electrical power source cable 24 move to an outer side of the water drainage socket 20 along the sloping surfaces 8*a* and 8*a* of the guide parts 8 and 8, so that it is possible to further prevent the water supply hose 23 and the electrical power source cable 24 from being interposed between the water drainage socket 20 and the water drainage outlet 5 (or between the water drainage socket 20 and the wall surface 10 with a water drainage pipe being provided thereon in a case where the water drainage socket 20 is attached to the water drainage outlet 5 on a back surface of the toilet body 2) during an operation for mounting the toilet body 2.

Furthermore, according to the toilet 1 as described above, the openings 9 and 9 are formed into a notch shape with an opened lower end. Thereby, it is possible to insert the water supply hose 23 and the electrical power source cable 24 through the openings 9 and 9 from a lower part of the toilet body 2 during an operation for mounting the toilet body 2. Hence, an operation for inserting the water supply hose 23 and the electrical power source cable 24 through the openings 9 and 9 is facilitated.

Additionally, although the openings 9 and 9 are of a notch shape in the embodiment as described above, this is not limiting and the openings 9 and 9 may be, for example, through-holes. If such a configuration is provided, it is possible to hold the water supply hose 23 and the electrical power source cable 24 that are tubular members at the openings 9 and 9 in a case where the toilet body 2 is mounted on the wall surface 10, and it is possible to prevent detachment or the like of tubular members 23 and 24 from the toilet body 2 during a mounting operation thereof.

Furthermore, one or three or more tubular members may be provided. Even in a case where one or three or more tubular members are provided, it is possible to prevent such a tubular member(s) from being interposed between the water drainage socket 20 and the water drainage outlet 5 due to the guide parts 8 and 8.

Toilet Apparatus 30

Figure 7:
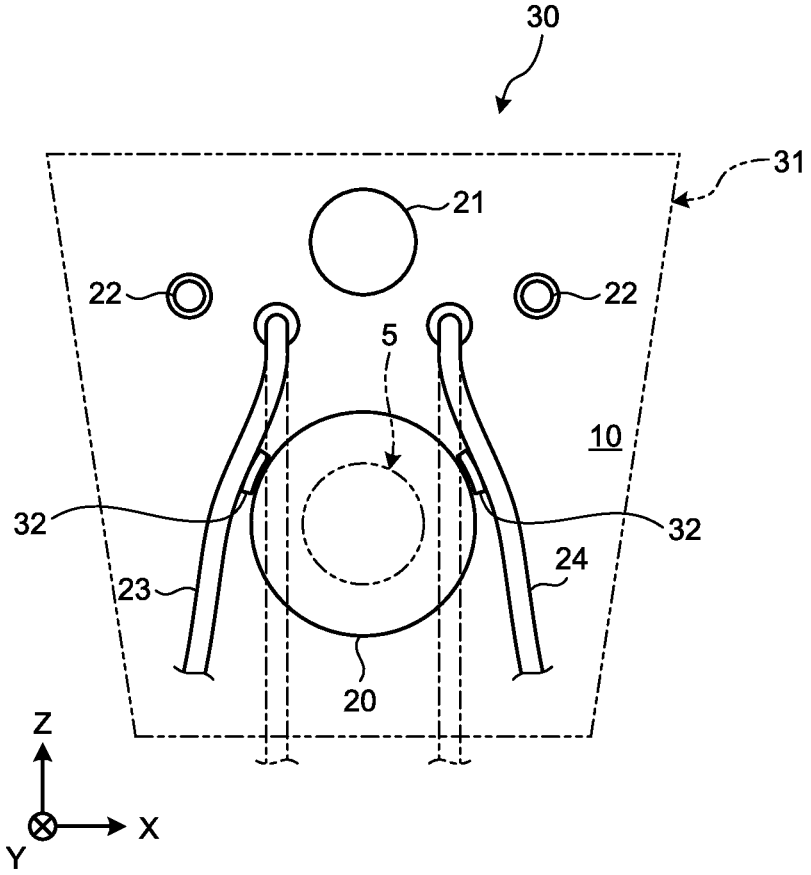
FIG. 7 is a diagram illustrating a toilet apparatus according to an embodiment.

Next, a toilet apparatus 30 according to an embodiment will be described with reference to FIG. 7. FIG. 7 is a diagram illustrating the toilet apparatus 30 according to an embodiment. Additionally, FIG. 7 is a schematic front elevational view illustrating a wall surface 10. As illustrated in FIG. 7, the toilet apparatus 30 includes a toilet body 31 and guide parts 32 and 32. Additionally, a configuration of the toilet body 31 is different from that of the toilet body 2 of the toilet 1 according to the embodiment as described above in that it does not have the guide parts 32 and 32 on a back surface thereof.

The toilet body 31 includes a bowl part and an insertion hole on an upper surface thereof, similarly to the toilet body 2 (see FIG. 2). Furthermore, the toilet body 31 includes a water drainage outlet 5, a water supply inlet, an insertion hole (a supporting hole), and an opening on a back surface thereof, similarly to the toilet body 2.

Furthermore, the toilet apparatus 30 includes a water drainage socket 20 and tubular members (a water supply hose 23 and an electrical power source cable 24) as well as the toilet body 31 and the guide parts 32 and 32 as described later.

The guide parts 32 and 32 are provided on an outer side of an outer peripheral surface of a (non-illustrated) inlet of a water drainage pipe on the wall surface 10. In detail, the guide parts 32 and 32 are provided on an outer side of the water drainage socket 20 that is connected to an inlet of a water drainage pipe (a side that is provided in a direction away from a center of the water drainage socket 20 on the wall surface 10 in a front elevational view).

The guide parts 32 and 32 protrude from the wall surface 10. The guide parts 32 and 32 are formed into a rib shape. The guide parts 32 and 32 hold the water supply hose 23 and the electrical power source cable 24 that are tubular members on a surface of the wall surface 10. The guide parts 32 and 32 are provided at a position where the water drainage socket 20 does not interfere therewith, so as to avoid the water drainage socket 20 that connects the water drainage outlet 5 and an inlet of a water drainage pipe on a back surface of the toilet body 31 in a state where the water supply hose 23 and the electrical power source cable 24 are held by the guide parts 32 and 32.

According to such a configuration, in a case where a toilet body is mounted on the wall surface 10, the water supply hose 23 and the electrical power source cable 24 that are tubular members are held by the guide parts 32 and 32 so as to be positioned on an outer side of the water drainage socket 20. Thereby, it is possible to prevent the water supply hose 23 and the electrical power source cable 24 from being interposed between the water drainage socket 20 and the water drainage outlet 5 (or between the water drainage socket 20 and the wall surface 10 with a water drainage pipe being provided thereon in a case where the water drainage socket 20 is attached to the water drainage outlet 5 on a back surface of the toilet body 2) during an operation for mounting the toilet body 31, and it is possible to improve workability.

According to an aspect of an embodiment, it is possible to improve workability.

Configuration (1) is a toilet, including a toilet body that has a water drainage outlet on a back surface thereof; and a water drainage socket that connects the water drainage outlet and an inlet of a water drainage pipe that is provided on a wall surface, wherein an opening that is provided to insert therethrough a tubular member that extends from the wall surface in a case where the toilet body is mounted on the wall surface and a guide part that guides the tubular member that is provided in a state where it is inserted through the opening so as to move to an outer side of the water drainage socket in a case where the toilet body is mounted on the wall surface are formed on a back surface of the toilet body.

According to Configuration (1), in a case where a toilet body is mounted on a wall surface, a tubular member that is provided in a state where it is inserted through an opening is guided by a guide part so as to move to an outer side of a water drainage socket. Thereby, it is possible to prevent a tubular member from being interposed between a water drainage socket and a water drainage outlet or between the water drainage socket and a wall surface with a water drainage pipe being provided thereon during an operation for mounting a toilet body, so that it is possible to improve workability.

Configuration (2) is the toilet according to Configuration (1), wherein the opening is formed on an outer side of a left or right side end of the water drainage socket on a back surface of the toilet body and the guide part is provided on a left or right inner side of the opening.

According to Configuration (2), in a case where a toilet body is mounted on a wall surface, a tubular member is displaced outward from a center of a water drainage socket in a leftward or rightward direction by an opening and the tubular member that is displaced outward from a center of the water drainage socket in a leftward or rightward direction is guided to an outer side of the water drainage socket by a guide part, so that it is possible to further prevent the tubular member from being interposed between the water drainage socket and a water drainage outlet or between the water drainage socket and the wall surface with a water drainage pipe being provided thereon during an operation for mounting the toilet body.

Configuration (3) is the toilet according to Configuration (1) or (2), wherein the opening is formed below a left or right side end of the water drainage socket on a back surface of the toilet body and the guide part is provided to extend above an upper end of the opening.

Furthermore, a tubular member moves to an outer side of a water drainage socket and is thereby provided on a further outer side in a leftward or rightward direction on a back surface of a toilet body during an operation for mounting the toilet body, so that an approach to the tubular member is facilitated.

According to Configuration (3), in a case where a toilet body is mounted on a wall surface, a tubular member is reliably displaced outward from a center of a water drainage socket in a leftward or rightward direction by an opening and the tubular member that is displaced outward from a center of the water drainage socket in a leftward or rightward direction is guided to an outer side of the water drainage socket by a guide part, so that it is possible to further prevent the tubular member from being interposed between the water drainage socket and a water drainage outlet or between the water drainage socket and the wall surface with a water drainage pipe being provided thereon during an operation for mounting the toilet body.

Configuration (4) is the toilet according to any one of Configurations (1) to (3), wherein the opening is formed into a notch shape with an opened lower end.

According to Configuration (4), it is possible to insert a tubular member through an opening from a bottom of a toilet body during an operation for mounting the toilet body. Accordingly, an operation for inserting a tubular member through an opening is facilitated.

Configuration (5) is the toilet according to Configuration (3) or (4), wherein the guide part has a sloping surface halfway from bottom to top.

According to Configuration (5), in a case where a toilet body is mounted on a wall surface, a gap is formed between a tip of a guide part and the wall surface, so that it is possible to prevent a tubular member from being interposed between the guide part and the wall surface. Furthermore, in a case where a toilet body is mounted on a wall surface, a tubular member moves to an outer side of a water drainage socket along a slope of a guide part, so that it is possible to further prevent the tubular member from being interposed between the water drainage socket and a water drainage outlet or between the water drainage socket and the wall surface with a water drainage pipe being provided thereon, during an operation for mounting the toilet body.

Configuration (6) is the toilet according to any one of Configurations (1) to (5), wherein the tubular member overlaps with an inlet of the water drainage pipe or the water drainage socket that is attached to the water drainage pipe in a state where it hangs down from the wall surface due to its own weight.

According to Configuration (6), even in a case where a tubular member overlaps with an inlet of a water drainage pipe or a water drainage socket that is attached to the water drainage pipe, it is possible to avoid interference between the tubular member and the water drainage socket in a case where a toilet body is mounted on a wall surface.

Configuration (7) is a toilet apparatus, including a toilet body that has a water drainage outlet on a back surface thereof, a water drainage socket that connects the water drainage outlet and an inlet of a water drainage pipe that is provided on a wall surface, a tubular member that extends from the wall surface, an opening that is provided on a back surface of the toilet body and provided to insert the tubular member therethrough in a case where the toilet body is mounted on the wall surface, and a guide part that is provided to protrude on an outer side of an inlet of the water drainage pipe on the wall surface and holds the tubular member that is provided in a state where it is inserted through the opening so as to be positioned on an outer side of the water drainage socket.

According to Configuration (7), in a case where a toilet body is mounted on a wall surface, a tubular member is held so as to be positioned on an outer side of a water drainage socket by a guide part. Thereby, it is possible to prevent a tubular member from being interposed between a water drainage socket and a water drainage outlet or between the water drainage socket and a wall surface with a water drainage pipe being provided thereon during an operation for mounting a toilet body, so that it is possible to improve workability.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A toilet, comprising:

a toilet body with a bowl part on an upper side thereof and a back surface that includes a water drainage outlet and an opening below a lower end of the water drainage outlet, the opening being configured to insert a tubular member therethrough;

a water drainage socket that connects the water drainage outlet to an inlet of a water drainage pipe; and a guide part that is provided on the back surface and guides the tubular member inserted through the opening to an outer side of the water drainage socket.

2. The toilet according to claim 1, wherein the back surface includes the opening on an outer side of a left side end of the water drainage socket or a right side end of the water drainage socket and the guide part is provided on a left inner side of the opening or a right inner side of the opening.

3. The toilet according to claim 1, wherein the back surface includes the opening below a left side end of the water drainage socket or a right side end of the water drainage socket and the guide part extends above an upper end of the opening.

4. The toilet according to claim 1, wherein the opening includes a notch shape with an opened lower end.

5. The toilet according to claim 1, wherein the guide part includes a sloping surface between a bottom of the guide part and a top of the guide part.

* * * * *